US005657509A

United States Patent [19]

Trautloff et al.

[11] Patent Number: 5,657,509

[45] Date of Patent: Aug. 19, 1997

[54] VACUUM EXTRACTOR

[75] Inventors: Gary L. Trautloff, Fullerton; Montgomery A. Bisson, Huntington Beach, both of Calif.

[73] Assignee: Professional Chemical Corporation, Chandler, Ariz.

[21] Appl. No.: 437,939

[22] Filed: May 9, 1995

[51] Int. Cl.[6] ..... A47L 5/36

[52] U.S. Cl. ..... 15/321; 15/353

[58] Field of Search ..... 15/320, 321, 353

[56] References Cited

U.S. PATENT DOCUMENTS

| | | | |
|---|---|---|---|
| 3,431,582 | 3/1969 | Grave | 15/321 |
| 3,774,261 | 11/1973 | Colt | 15/321 |
| 3,812,552 | 5/1974 | Blackmon | 15/321 |
| 3,869,749 | 3/1975 | London et al. | 15/302 |
| 4,019,218 | 4/1977 | Cyphert | 15/321 |
| 4,586,208 | 5/1986 | Trevarthen | 15/321 X |
| 4,809,397 | 3/1989 | Jacobs et al. | 15/321 X |
| 4,934,017 | 6/1990 | Kent | 15/321 |
| 5,210,902 | 5/1993 | Lee et al. | 15/321 |
| 5,383,251 | 1/1995 | Whitaker et al. | 15/320 |
| 5,526,547 | 6/1996 | Williams et al. | 15/320 |

*Primary Examiner*—Chris K. Moore
*Attorney, Agent, or Firm*—Hawes, Fischer & Dickinson

[57] ABSTRACT

The vacuum extractor of the present invention is a self contained system for delivery of hot cleaning solution to a surface and vacuum removal of the spent solution either simultaneous with its application or at a later time through a vacuum system which deposits the spent cleaning solution in an upper housing. The extractor is configured to dump the cleaning solution from an upper housing which may be pivotally tipped upwardly from the front to enhance the draining of spent solution. The rear of the extractor of the present invention is configured to enable the extractor to be back up to and located adjacent a toilet bowl. The upper housing containing the spent solution is high enough to be pivoted over the toilet bowl and emptied, while still pivotally attached to the lower housing. The dump valve is positioned to be protected from damage from bumping surrounding structure. The point of pivotal movement of the upper housing is significantly rearward of the junction between the upper housing and the lower housing to enable the dump valve to be positioned further rearwardly upon tilting of the upper housing. The lower housing defines an inwardly spaced area to assist the extractor to be more closely positioned to a toilet bowl to facilitate a clean removal of the spent cleaning solution.

13 Claims, 6 Drawing Sheets

VACUUM EXTRACTOR

FIELD OF THE INVENTION

The present invention relates to the field of carpet and upholstery cleaning devices, known in the industry as soil extractors. More specifically, the present invention relates to a portable extractor system and a multi stage vacuum system, including heat capability.

BACKGROUND OF THE INVENTION

Equipment used to clean upholstery, carpets, and other structures which can keep and hold dirt need to be powerful in order to perform effectively. Cleaning solution, which may be a mixture of soap, water, or other cleaning agent should be applied hot, and removed quickly from the surface to be cleaned. Thus the means for removing the dirt laden cleaning solution should also be powerful and minimize the time in which the dirt laden cleaning solution is present, and maximize the efficiency with which it is removed.

The requirement for power carries an associated requirement of durability. Powerful cleaning machines require durable working parts to form a machine having long life and low maintenance. However, the cost of such machinery, given the requirements for power and durability, tend to rise significantly if not designed with an efficiency of cost in mind.

The severity of service should also be taken to account. The environment in which an extractor works has tendencies toward corrosion and the associated structural weakening problems caused by such corrosion. Thus the structures used should not only be corrosion resistant, but should also be accessible for cleaning of the unit since cleaning minimizes the long term effects of exposure to cleaning solution. Cleanability is also important for appearance, and operation of a cleaning unit in areas which are easily soiled by transportation of the cleaning unit.

In addition, the unit should be designed with the operating environment in mind. The exterior of the unit should be free from sharp edges which might damage the walls of its surroundings during its use. The needed unit should, even if inadvertently brushed against a wall, create minimal damage.

SUMMARY OF THE INVENTION

The vacuum extractor of the present invention is a self contained system for delivery of hot cleaning solution to a surface and vacuum removal of the spent solution either simultaneous with its application or at a later time through a vacuum system which deposits the spent cleaning solution in an upper housing.

The extractor is configured to dump the cleaning solution from an upper housing which may be pivotally tipped upwardly from the front to enhance the draining of spent solution. The rear of the extractor of the present invention is configured to enable the extractor to be back up to and located adjacent a toilet bowl. The upper housing containing the spent solution is high enough to be pivoted over the toilet bowl and emptied, while still pivotally attached to the lower housing.

The dump valve is positioned to be protected from damage from bumping surrounding structure. The point of pivotal movement of the upper housing is significantly rearward of the junction between the upper housing and the lower housing to enable the dump valve to be positioned further rearwardly upon tilting of the upper housing. The lower housing defines an inwardly spaced area to assist the extractor to be more closely positioned to a toilet bowl to facilitate a clean removal of the spent cleaning solution.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
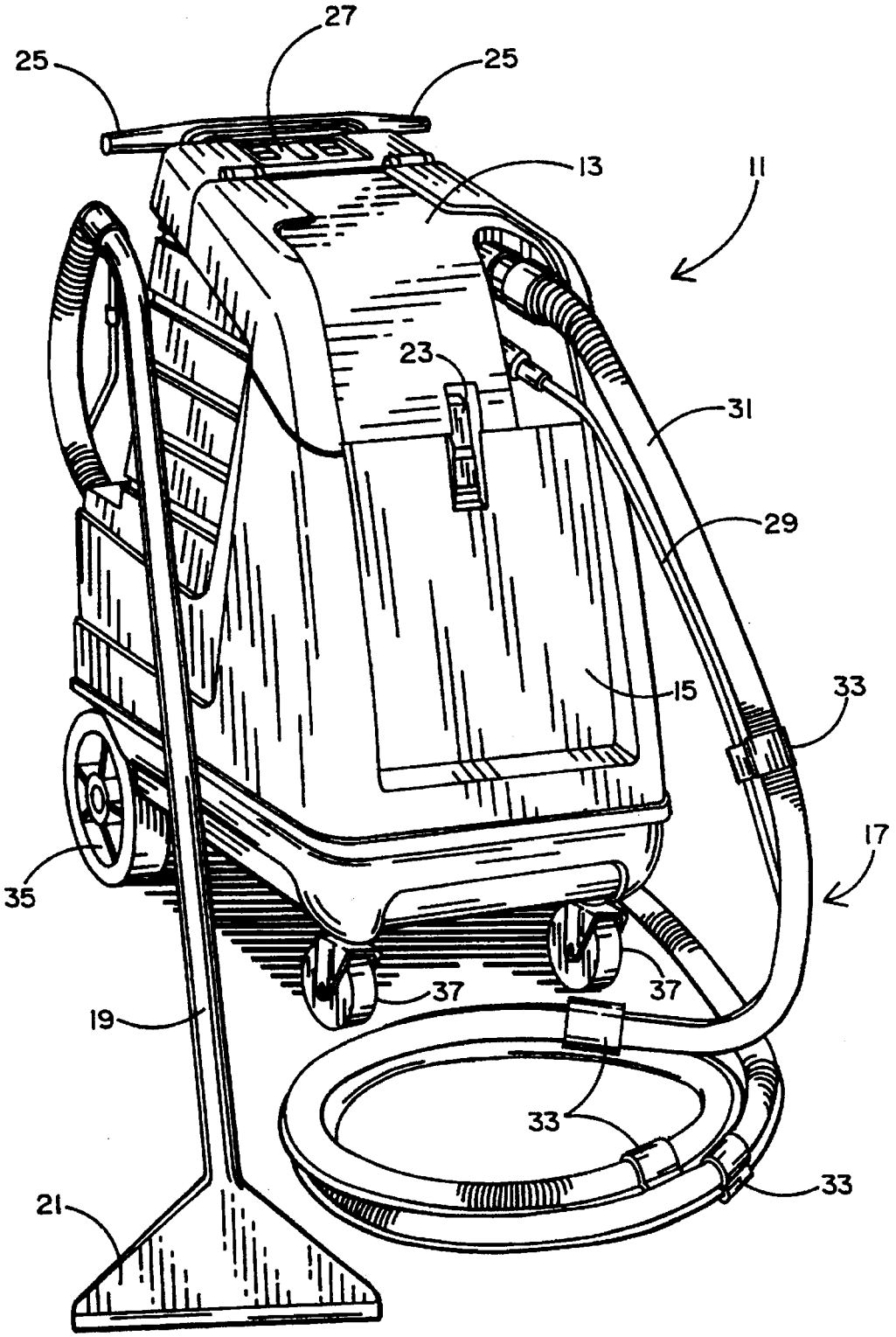
FIG. 1 is a perspective view of the dirt extractor of the present invention shown with its hose set and wand connected and in position.

The description and operation of the invention will be best described with reference to FIG. 1. FIG. 1 is a front perspective view of the extractor 11 of the present invention, and illustrating its upper housing 13, lower housing 15 and hose set 17. At the end of hose set 17 is a rigid wand 19 having a cleaning head 21. Holding the upper housing 13 into a closed hinged relationship with the lower housing 15 is a manual latch 23. As will be shown, the opening of the upper housing 15 will enable user access to the mechanical components in the extractor 11.

Other features of the extractor 11 visible from the front view is a pair of opposing handles 25 which are relatively closer to the rear of the unit, and are widely spaced to give users mechanical advantage in steering the unit left and right. The positioning of the handles 25 further enable mechanical advantage to be had in the opening of the upper housing 13 with respect to the lower housing 15, when access is to be had with respect to the extractor 11.

As can be seen in FIG. 1, the extractor 11 has a control panel area 27 which is located adjacent and in front of the handle 25 to facilitate easy access to the controls of the extractor 11.

As can be seen, the hose set 17 is made up of a pair of hoses, including a relatively smaller cleaning solution delivery hose 29, and a relatively larger vacuum hose 31. These two hoses are joined together at periodic positions along their lengths by a series of ties 33, which may be specialized in shape to exactly accommodate the diameters of the delivery hose 29 and the vacuum hose 31 without compression thereof, and for facilitating the flexible handling of the hose set 17. Ideally, the hose set 17 may be between ten to 35 feet in length, with the preferable length being about 25 feet.

Longer lengths will usually not deleteriously affect the solution delivery hose 29, but may cause significant pressure drop in the vacuum hose 31. The vacuum return hose 31 will handle a mixture of air and liquids. As such, the vacuum needed is powerful, and since there will be two phase flow, the return hose 31 will be expected to handle drastic fluctuations in internal pressure due to the sometimes slugging nature of the two phase flow. The hose set 17 continues as separate path spaces within the wand 19 and up to and including the cleaning head 21. As is shown, the hose 29 connects into a separate inlet in wand 19, while hose 31 connects to the main, larger inlet of wand 19.

As can also be seen, the extractor 11 is fitted with larger rear wheels 35 which will usually not be adapted to turn or swivel, and smaller front wheels 37 which are adapted to swivel. The rear wheels 35 rotate in fixed, parallel planes about a horizontal axis. The front wheels 37 are caster type which can completely pivot, move in any direction, and rotate about a vertical axis. The frontal, close mounting of the departure point for the return hose 31 and the solution delivery hose 29 helps to reduce the stress and strain due to the user pulling the hose set 17 to its maximum extent, and or the natural tendency to use the hoses to pull the extractor 11. Further, the placement of the departure point for the return hose 31 and the solution delivery hose 29 onto a single area of the overall housing of the extractor 11 such that the attachment points of such hoses remains fixed, will greatly reduce the wear and tear the hoses due to their physical distance of separation. Since one hose is intended for single phase liquid service and the other is intended for two phase liquid and gas service, and since the devices and structures within equipment which uses such hoses is diverse, there would be a natural tendency to separate the point of departure for such hoses.

Figure 2:
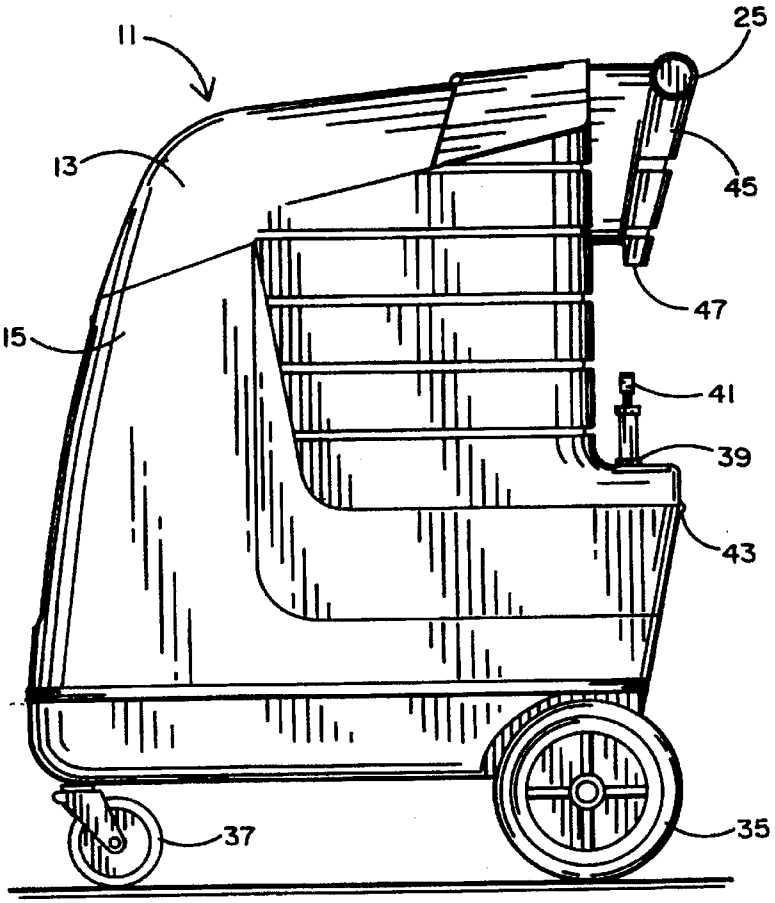
FIG. 2 is a side view of the extractor shown in FIG. 1, but without the hose set and wand connected.

Referring to FIG. 2, a side view of the extractor 11 of the present invention further illustrates advantageous structure thereof. The handles 25 are shown as depending from structure which is fully integrated into the upper housing 13, which provides for a stable and sturdy connection with the extractor 11 as a whole. Below the handles 25 is seen a dump valve 39 and including a "T" shaped actuator handle 41. A rearwardly extending hinge 43 is seen, which causes the upper housing 13 to pivot with respect to the lower housing 15. Although the details of the dump valve 39 and rear portion of the extractor 11 are not immediately seen in FIG. 2, there is cooperating structure which enables the positioning of the upper housing 13 to dump extracted cleaning solution which collects in a chamber in the upper housing 13.

Also note the remainder of the projection underlying the handles 25 which form a cord wrap 45. Most cord wraps consist of sharply projecting members which are spaced apart and which have to have sufficient projection to handle the volume of cord wrapped between the surface from which they arise to the tip end of their length of projection. Conventionally available cord wraps cause two problems. First, they must be affixed to the housing. Such affixation requires riveting or screws, or other foreign materials to affix the structure. In the affixation, there may be a mismatch between the structure to which they are attached, both in terms of the material and the strengths of the material. The structure should be compatible with the surface to which it is attached. Further, especially where metal components are used, there may be corrosion. In the case of an extractor, where two compartments will be dedicated to liquid storage, invading the housing surface to provide structural support can cause leakage.

The cord wrap 45 of the extractor 11 is formed integrally with the upper housing 13. The cord wrap forms a rectangular projection space, which is bound on the top by the handles 25, and which extends downwardly to form a lower lip 47 and which forms a complete rectangular wrapping space for the electric cord (not yet shown in the Figures). There is sufficient area in the channel of the cord wrap 45 to accommodate the complete length of the electric cord.

Figure 3:
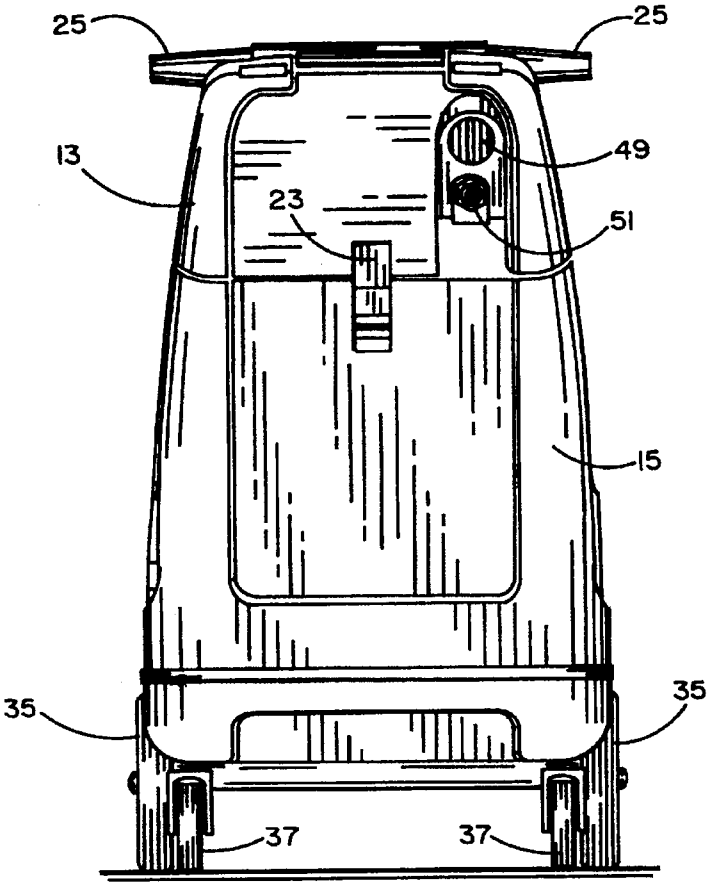
FIG. 3 is a front view of the extractor shown in FIGS. 1 and 2.

Referring to FIG. 3, the front view of the extractor 11 is seen, but without the hose set 17 connected with the upper housing 13. A vacuum connector port 49, which is marks the vacuum inlet of the upper housing 13, is shown overlying a solution connection port 51, both commonly supported by the upper housing 13. An expanded view of the latch 23 is shown which is preferably of the clamp down type having a hook shaped member attached to the upper housing 13, and a grasping member, attached to the lower housing 15, which is made to engage the latch 23 and pull downwardly on the hook shaped member and the upper housing, with respect to the lower housing, and into a locked position.

Figure 4:
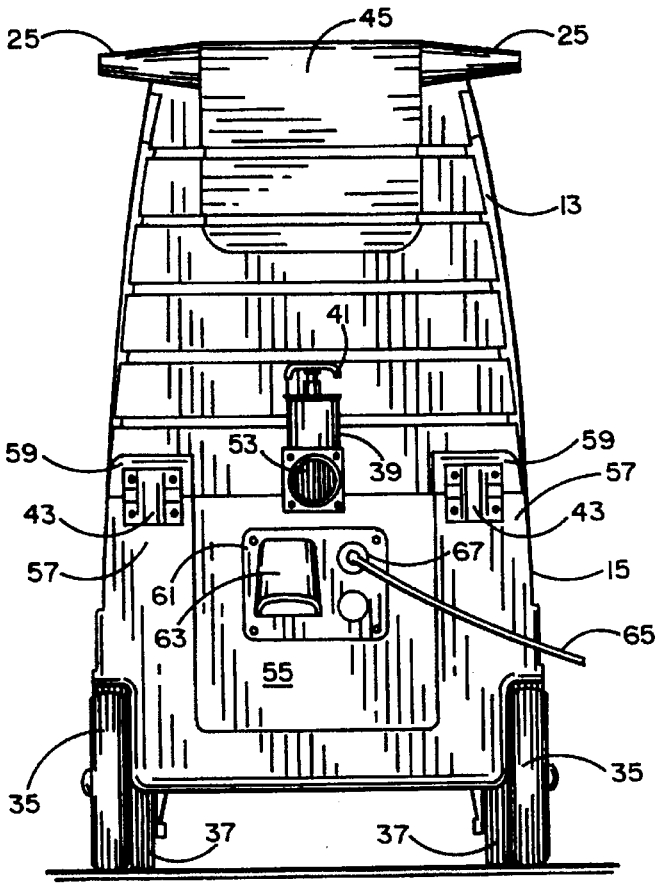
FIG. 4 is a rear view of the extractor shown in FIGS. 1–3.

Referring to FIG. 4, a good deal of the structures of the extractor 11 will be shown in greater detail. The hinges 43 are seen as a pair of spaced apart hinges 41. The dump valve 39 and including a "T" shaped actuator handle 41 are seen in relationship to their exit port 53. The valve 39, handle 41 and exit port 53 are all integrally attached to the upper housing 13, and including an internal reservoir (to be shown).

The lower housing immediately under the valve 39 has an inwardly spaced area 55 bound by a rearwardly extending structure 57 on either side of the inwardly spaced area 55. There are a pair of rearwardly extending areas 59 on the upper housing 13 which evenly overlie the extending structure 57 on the lower housing 15. It is at the juncture of the opposing extended areas 59 and 57 that the hinges 43 overlie. Thus the hinged pivotal displacement of the upper housing 13 is had with respect to rearwardly displaced structures which enable the point of pivot to occur rearwardly with respect to he valve 39, and the end of the exit port 53.

The placement of the dump valve 39 at the height shown in FIG. 4, in combination with the ability of the upper housing 13 to tilt gives the extractor 11 structural advantages, and advantages of facilitation to the user of the extractor 11. These two structural aspects, coupled with the inwardly spaced area 55, even further ad the advantages available with the extractor 11. When the rearward surfaces of extractor 11, shown most prominently in FIG. 4, are placed against a toilet bowl, the upper housing can be pivotally displaced upwardly and toward the bowl (not shown) and the valve 39 actuated to the open position.

The geometry of the structures shown in FIG. 4 act to bring the exit port 53 upwardly and over the toilet bowl. Thus at the time of dump, the exit port 53 will be significantly upwardly and over the toilet bowl. The placement of the inwardly spaced area, especially in conjunction with more rearwardly located hinges 43 about which the pivoting takes place, enables the exit port 53 to brought farther over the bowl to insure a neat, clean removal of the dirty cleaning solution.

The above structures enable the ease of use without more structure with an important purpose. The extractor 11 could have been fitted with externally extending structure for further insuring the ability to "aim" the flow of dirty cleaning solution into a toilet bowl. However, given the heavy duty treatment to which extractors such as extractor 11 is to be subjected, as well as other equipment of this type, the placement of the structures accomplishes the dual objectives of providing protection for the dump valve 39, as well as enabling the positioning of the dump valve 39 exit port 53 over a disposal structure such as a toilet bowl.

Directly below the dump valve 39, and within the inwardly spaced area 55 is a plate 61 which provides service structures related to the operation of the extractor 11. At the left is a vacuum blower exhaust port 63 which downwardly directs the exhaust air from the extractor 11 which results from creating a vacuum service from the extractor 11. This port 63 directs the flow of exhaust air downwardly to minimize the disruptive effect on surrounding structure. The shape of port 63 is also designed to prevent any inadvertent splashes or liquids from entering the lower housing 15 through the exhaust port 63, particularly when the extractor 11 is not running.

At the upper right of the plate 61, an electric cord 65 enters through an access hole 67. This strengthens the ability of the extractor 11 to withstand pulls and tugs on the cord 65 by virtue of the cord 65's entrance through a plate 61.

Figure 5:
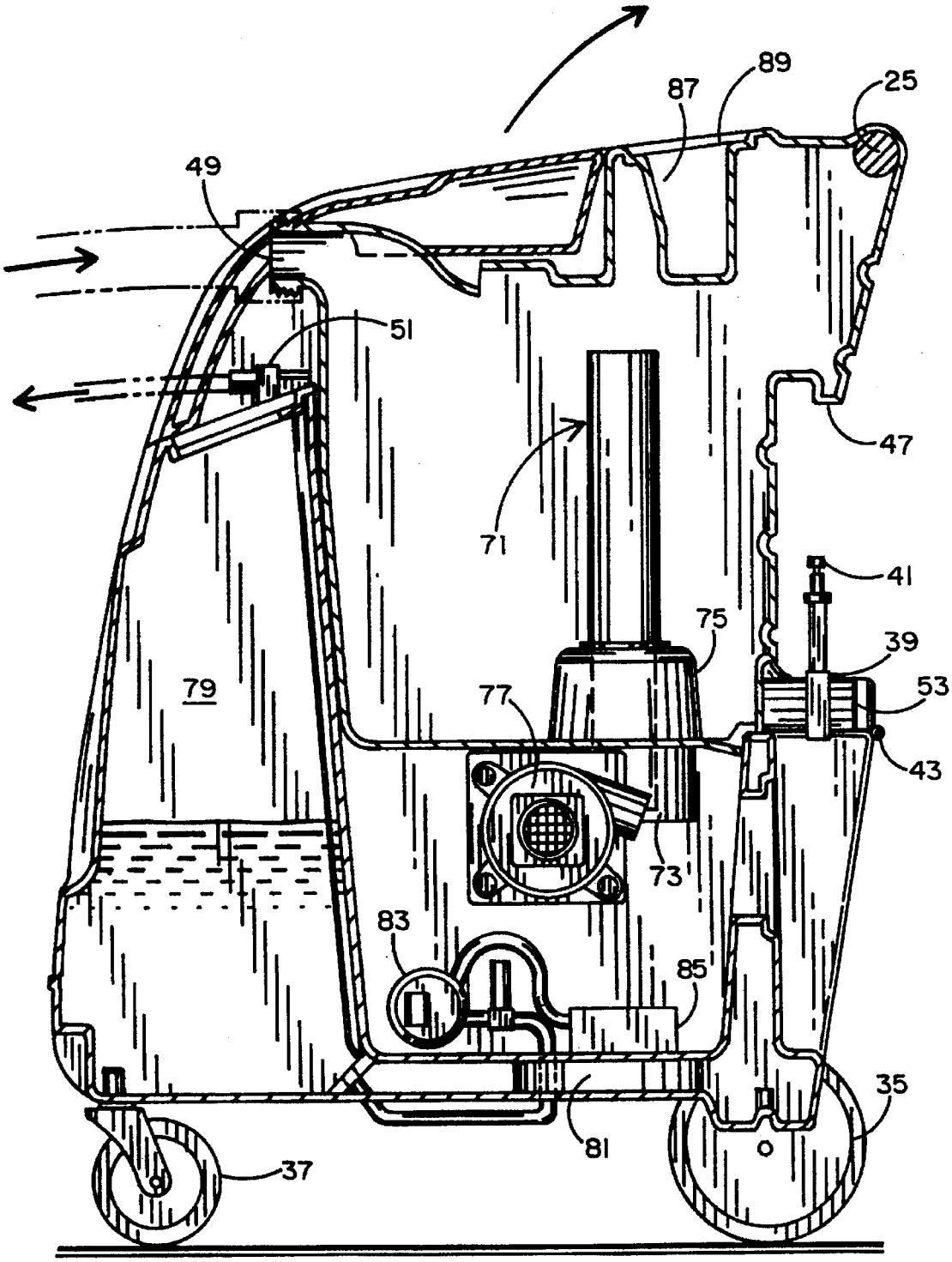
FIG. 5 is a side sectional view of the extractor shown in FIGS. 1–4, and illustrating the internal compartments thereof and the separation between the upper and lower housing portions.

Referring to FIG. 5, a side sectional view of the extractor 11 reveals the inner configuration and workings of the unit. This sectional view is somewhat schematic in that it illustrates ports of connectivity which may not lie in a single plane.

With regard to the upper housing 13, FIG. 5 reveals it to be separate from the lower housing 15, except for its connection at the rearwardly extending hinges 43. The upper housing 13 is intended to become filled with soiled or waste solution. Prominently placed in the center of the upper housing 13 is a riser 71. The riser 71 forms a path through which suction air is withdrawn from the upper housing 13, and acts as a conduit for the upper housing 13's vacuum outlet. The vacuum connector port 49 is shown as the point of entry of the waste cleaning fluid, which is then directed downwardly and into the upper housing 13. Note as was shown in FIG. 1 that the point of connection of the vacuum connector port 49 was significantly displaced to one side of the center of the upper housing 13. This causes the entering fluids to swirl with respect to the more centrally located riser 71 to employ a cyclonic principle of separation, with the heavier liquids being directed down, and the suction air being directed over the top of and down into the riser 71.

A first blower 73 is attached to the underside of the upper housing 13, and partially within an expanded bottom portion 75 of the riser 71. The closeness with which blower 73 is placed with respect to the uppermost portion of the riser 71 will reduce the pressure drop. Blower 73 has its suction oriented in fluid connection with the central portion of the riser 71. To the side of the bottom portion of riser 71 is a second blower 77. The second blower 77 is also preferably attached to the bottom of the upper housing 13. This second blower has a suction connected to the outlet of the first blower 73 in order to give a two stage processing to the suction air from the riser 71. The output of the second blower 77 is directed to the rear of the extractor 11 and is directed downwardly through the vacuum blower exhaust port 63.

By mounting the blowers 73 and 77 to the upper housing 13 underside, much of the vibration energy is absorbed by the spent or dirty cleaning fluid which returns to the upper housing. This is particularly true for blower 73 which is surrounded by return solution, and also true, though to a lesser extent for blower 77 which underlies and is connected to the upper housing. When the extractor 11 is in position, the blowers are also adjacent the cleaning fluid reservoir (to be shown) which also acts to absorb some of the vibration from the blowers 73 and 77.

Of course more blowers may be employed, in either series or parallel configurations, although series configurations are favored due to the pressure drop which will occur in the vacuum hose 31. As will be seen, the blowers 73 and 77 will be tilted back with the tilting action of the upper housing 13.

In the lower housing 15, several structures can be identified. At the forward portion, a fresh fluid reservoir 79 is seen having a fluid connection leading through a large aperture at the bottom of the lower housing 15 and into a pump 83. From the pump 83, a fluid line leads to a heater unit 85. The heater unit 85 is used to rapidly heat the pumped fluid before the fluid continues through the solution connection port 51 and through the smaller cleaning solution delivery hose 29. The fluid connection between the heater unit 85 and the port 51 is not shown in FIG. 5.

Note that the port 51 is attached to the lower housing 15, and that it is configured to be directly below the vacuum connector port 49, and to provide an even connection therewith.

In the upper housing 13 is a access space 87 covered by a control panel 89. The control panel 89 can provide switches for operation of the first and second blowers 73 and 77, as well as the heater unit 85. The temperature of the cleaning solution, the strength of the vacuum produced, and the rate of delivery of the cleaning solution can be controlled. The electrical connection between the access space 87 and the structures in the lower housing 85 can be accomplished through access spaces not shown in the Figures, or through free connection from the upper housing 13 and lower housing 15 outside of such upper and lower housings 13 and 15.

Figure 6:
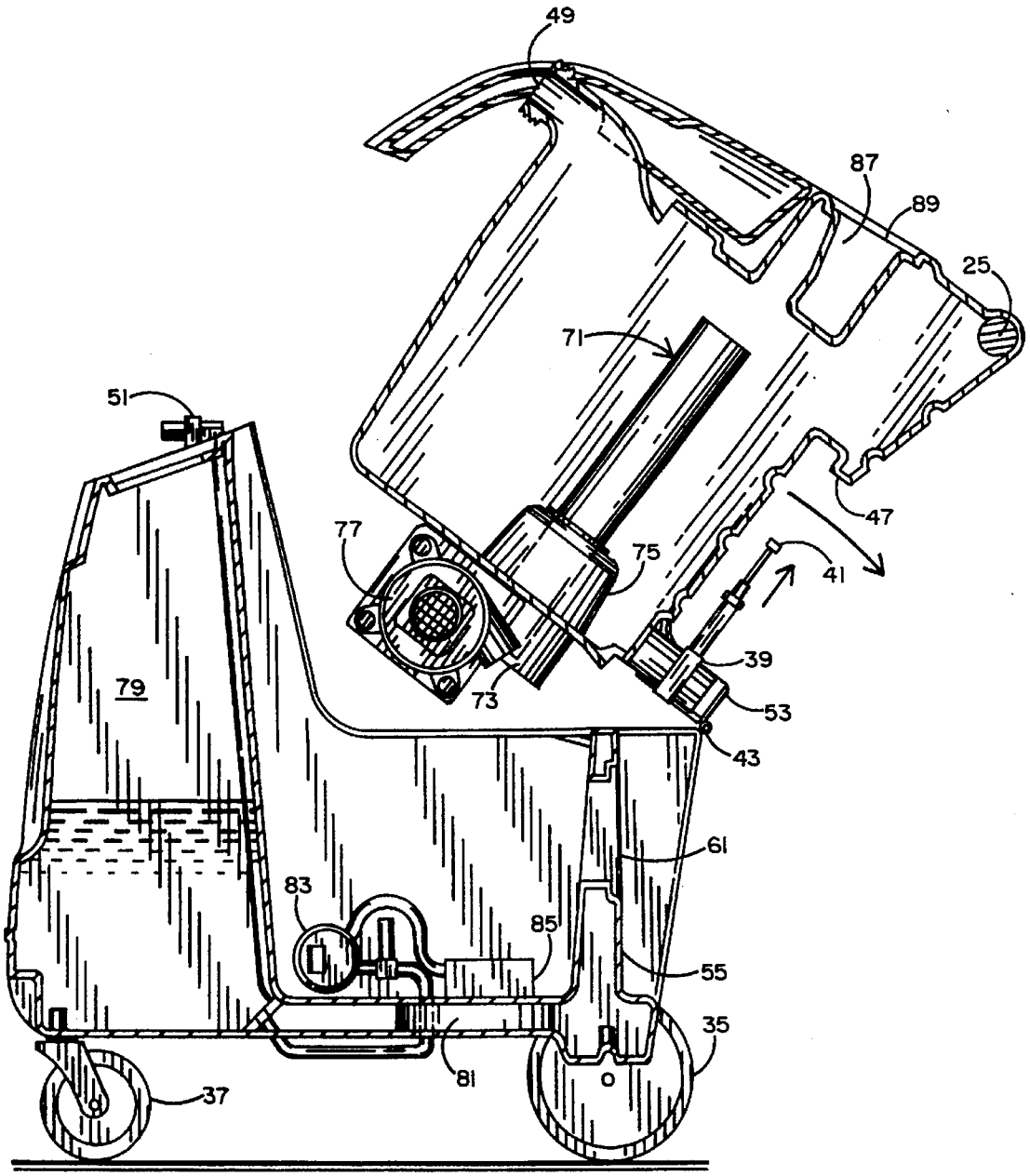
FIG. 6 is a side sectional view of the extractor similar to that shown in FIG. 5, but illustrating hinged movement of the upper housing portion with respect to the lower housing portion.

Referring to FIG. 6, a view of the extractor 11 in side sectional view is shown where the upper housing 13 is being pivoted rearward with respect to the lower housing 15. Note that at this point the vacuum connector port 49 is urged upwardly and away from the solution connection port 51, which is fixed to the lower housing 15. Note the position of the exit port 53 with respect to the inwardly spaced area 55. Note also the upward displacement of the "T" shaped handle 41 with respect to the dump valve 39, a position it would assume during the dumping operation. It is understood that exit port 53 may contain further permanent or temporary structures to extend its reach.

Figure 7:
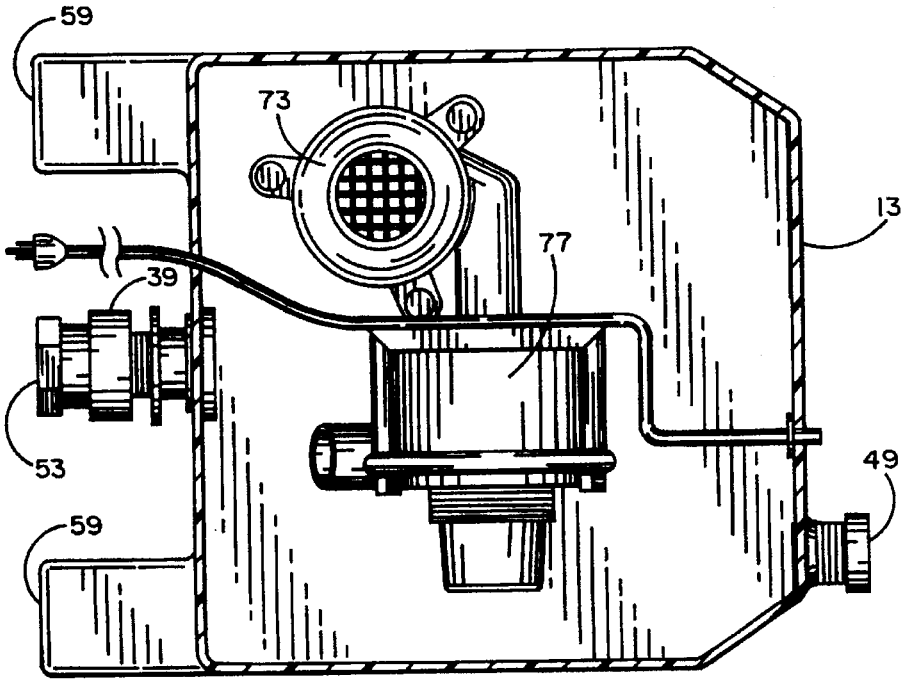
FIG. 7 is a bottom view of the upper housing portion shown in FIGS. 1–6.

Referring to FIG. 7, a view of the bottom of the upper housing 13 is shown which illustrates the first and second blowers 73 and 77. As can be seen the electric cord 65 extends onto the area of the blowers 73 and 77 and goes past and beyond the bottom area to extend through to the control panel 89. Other controlled lines (not shown) lead to the heater unit 85.

Figure 8:
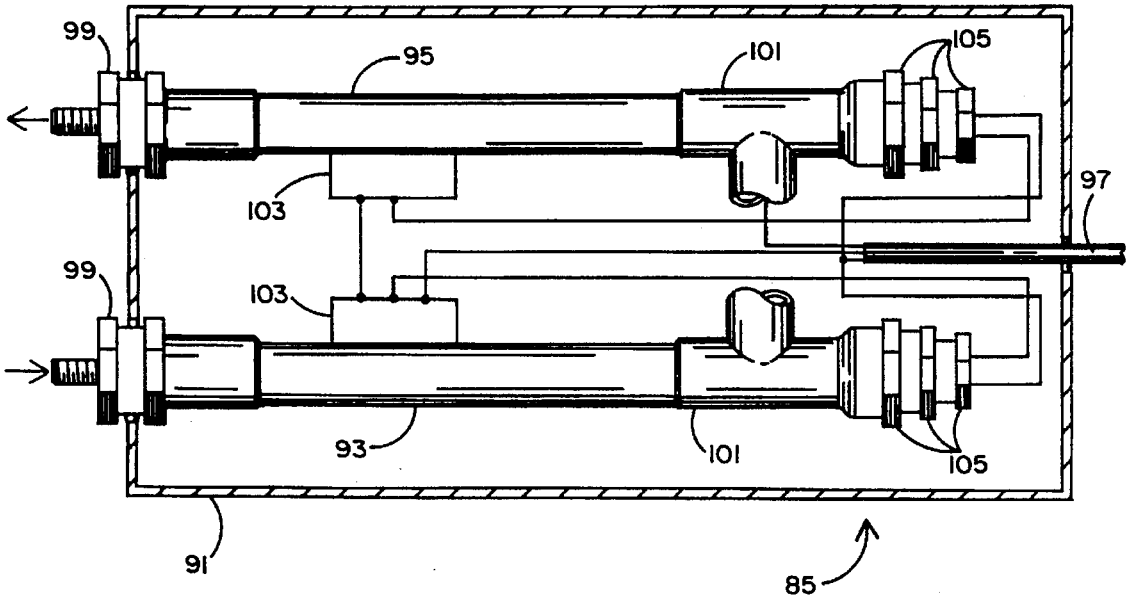
FIG. 8 is a detailed internal view of the heater unit shown in FIGS. 5 and 6.

Referring to FIG. 8, one possible configuration of the heater unit 85 is illustrated. Heater unit 85 has a housing 91, preferably of insulative material to insulate the surroundings from generated heat. The heater unit 85 is of balanced construction having an inlet pipe side 93 and an outlet pipe side 95. An inlet cord 97 is shown extending across the boundary of the housing 91 and connected to heating elements (not shown) within the tubular bodies of the inlet pipe and outlet pipe sides 93 and 95. The heating elements generally extend down the center of the inlet pipe and outlet pipe sides 93 and 95 to define an annular flow space.

Pipes 93 and 95 each have a brass bushing 99 and are made of 0.75 inch copper pipe, and are connected to each other through a 0.75 inch copper T connection 101. This connection is shown in broken format to illustrate the extent of the electrical connection. The control units 103 are adjacent the pipes 93 and 95 and also electrically connected to inlet cord 97. In this configuration, the control units 103 control the current applied to the heating elements (not shown) within the pipes 93 and 95. and which are held in by pipe fittings 105 at the ends of pipes 93 and 95.

The control units 103 may be microprocessor units or analog temperature control units. A portion of the electrical signals available by inlet cord 97 may include user selectable temperature parameters. Also, the control unit may also act based upon the temperature of the inlet cleaning solution.

The operation of the extractor 11 is as follows. The cleaning solution is charged into the fresh fluid reservoir 79 through a fill cap (not shown). The operator can then activate the extractor 11 to begin to apply heated cleaning solution by starting pump 83 and energizing heater unit 85 to deliver such hot cleaning solution through the wand 19. The first and second blowers 73 and 77 will be simultaneously activated to begin to draw, in fashion, in two face fashion, the cleaning fluid which was applied through the rigid wand 19. Thus the cleaning fluid may be withdrawn as rapidly as it is applied. In other cases however, it may be desirable to first apply the cleaning fluid and allow it to stand before removal. The controls of the control panel 89 can help in separately controlling the blowers 77 and 73 apart from the pump 83 and heater unit 85.

While the present invention has been described in terms of an extractor and cleaning device, one skilled in the art will realize that the structure and techniques of the present invention can be applied to many appliances. The present invention may be applied in any situation where utility advantages are to be derived from the cooperating combination of structures with ease of use and efficiency in mind.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A cleaning system comprising:

a lower housing having a cleaning fluid reservoir and a cleaning fluid outlet and wherein said lower housing includes an inwardly spaced surface area having a rearwardly extending structure;

an upper housing pivotally engaged with said lower housing and having a vacuum inlet, and a vacuum outlet, and wherein said upper housing pivotally is supported from said rearwardly extending structure;

a first blower having a suction side in communication with said vacuum outlet of said upper housing and an exhaust in communication with the atmosphere;

a pump having an inlet connected to said cleaning fluid reservoir and an outlet connected to said cleaning fluid outlet;

wheels, supporting said lower housing and enabling the rolling movement of said lower housing;

a vacuum hose having a first end connected to said vacuum inlet of said upper housing and a second end;

a cleaning fluid supply hose having a first end connected to said cleaning fluid outlet and a second end; and a cleaning wand connected to said cleaning fluid supply hose and to said vacuum hose.

2. The cleaning system recited in claim 1 wherein said suction side of said first blower communicates with said upper housing through a vertically cylindrical riser.

3. The cleaning system of claim 2 wherein said vertically cylindrical riser includes an expanded bottom portion and wherein said first blower resides partially within said expanded bottom portion.

4. The cleaning system recited in claim 3 and further comprising a second blower having a suction and an outlet, and wherein said suction of said second blower is connected to said exhaust of said first blower and wherein said outlet of said second blower is in communication with the atmosphere.

5. The cleaning system recited in claim 1 wherein said upper housing includes a pair of rearwardly extending surface areas, and wherein said upper housing is pivotally connected to said rearwardly extending structure from said rearwardly extending surface areas.

6. The cleaning system of claim 5 and further comprising a latch, engageable between said upper housing and said lower housing to selectively prevent pivotal displacement of said upper housing with respect to said lower housing.

7. The cleaning system of claim 1 and further comprising a dump valve carried on said upper housing and adjacent said lower housing and overlaying said inwardly spaced surface area.

8. The cleaning system as recited in claim 1 wherein said upper housing includes a pair of integrally molded handles to enable said extractor system to be manually moved about.

9. A cleaning system including the cleaning system as recited in claim 8 and wherein said pair of integrally molded handles depend from a rearwardly extending structure forming an integrally molded cord wrap.

10. The cleaning system recited in claim 1 wherein said wheels further comprise a pair of rear wheels turning in fixed parallel planes, and a pair of front wheels mounted to said lower housing with swiveling casters.

11. The cleaning system recited in claim 1 and further comprising a heater unit, carried within said lower housing and having an input connected to said output of said pump, and having an output connected to said cleaning fluid outlet.

12. The cleaning system recited in claim 11 wherein said heater unit further comprises:

housing defining an electrical inlet, a first aperture and a second aperture;

an inlet pipe extending through said first aperture;

an outlet pipe extending through said second aperture and having a fluid connection to said inlet pipe;

an electric heating element carried by at least one of said inlet pipe and said outlet pipe, and having conductors connected to said electric heating element and extending through said electrical inlet.

13. The cleaning system recited in claim 12 and further comprising a controller, adjacent at least one of said inlet pipe and said outlet pipe, and in electrical connection with said electric heating element, to control the energization of said electrical heating element.

* * * * *